US008992704B2

(12) United States Patent
Maki et al.

(10) Patent No.: US 8,992,704 B2
(45) Date of Patent: Mar. 31, 2015

(54) ALUMINUM PLATED STEEL SHEET FOR RAPID HEATING HOT-STAMPING, PRODUCTION METHOD OF THE SAME AND RAPID HEATING HOT-STAMPING METHOD BY USING THIS STEEL SHEET

(75) Inventors: Jun Maki, Tokyo (JP); Masayuki Abe, Tokyo (JP); Kazuhisa Kusumi, Tokyo (JP); Yasushi Tsukano, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1064 days.

(21) Appl. No.: 12/737,398

(22) PCT Filed: Jul. 13, 2009

(86) PCT No.: PCT/JP2009/063015

§ 371 (c)(1),
(2), (4) Date: Feb. 11, 2011

(87) PCT Pub. No.: WO2010/005121

PCT Pub. Date: Jan. 14, 2010

(65) Prior Publication Data

US 2011/0174418 A1 Jul. 21, 2011

(30) Foreign Application Priority Data

Jul. 11, 2008 (JP) ..... 2008-181341

(51) Int. Cl.
*C23C 2/12* (2006.01)
*C21D 8/02* (2006.01)
(Continued)

(52) U.S. Cl.
CPC . *C23C 2/28* (2013.01); *C21D 1/673* (2013.01); *C21D 8/0205* (2013.01);
(Continued)

(58) Field of Classification Search
USPC ..... 148/531, 320
See application file for complete search history.

(56) References Cited

U.S. PATENT DOCUMENTS 5,447,754 A 9/1995 Jasper
2007/0163685 A1 7/2007 Kusumi et al.

FOREIGN PATENT DOCUMENTS

CN 1118019 3/1996
CN 1984732 6/2007
(Continued)

OTHER PUBLICATIONS

International Search Report dated Oct. 20, 2009 issued in corresponding PCT Application No. PCT/JP2009/063015.
(Continued)

*Primary Examiner* — Roy King
*Assistant Examiner* — Janelle Morillo
(74) *Attorney, Agent, or Firm* — Kenyon & Kenyon LLP

(57) ABSTRACT

The present invention solves the problem of melting of Al in heating before hot-stamping, which had been a problem in the past in applying hot-stamping to Al-plated steel sheet, and provides Al-plated steel sheet for hot-stamping and a method of hot-stamping using that Al-plated steel sheet to solve the problem of delayed fracture due to residual hydrogen, and, furthermore, a method of a rapid heating hot-stamping using that Al-plated steel sheet.

The Al-plated steel sheet of the present invention is produced by annealing the Al-plated steel sheet as coiled in a box-anneal furnace for the time and at the temperature indicated in FIG. 5, and alloying of a plated Al and a steel sheet.

Further, a method of rapid heating hot-stamping in the present invention is characterized by cutting out a stamping blank of an Al-plated steel sheet, and heating that blank in heating before hot-stamping by an average temperature with a rising rate of 40° C./sec or more and a time of exposure to an environment of 700° C. or more of 20 seconds or less, and then hot-stamping it.

9 Claims, 6 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |
| ***C23C 2/28*** | (2006.01) |
| ***C23C 26/00*** | (2006.01) |
| *C21D 1/673* | (2006.01) |

(52) U.S. Cl.

CPC ..... *C21D 8/0278* (2013.01); *C22C 38/001* (2013.01); *C22C 38/02* (2013.01); *C22C 38/04* (2013.01); *C22C 38/06* (2013.01); *C22C 38/28* (2013.01); *C22C 38/32* (2013.01); *C23C 2/12* (2013.01); *C23C 26/00* (2013.01)

USPC ..... 148/531; 148/320

(56) References Cited

FOREIGN PATENT DOCUMENTS

| | | | | |
|---|---|---|---|---|
| CN | 101316942 | | | 12/2008 |
| JP | 63007359 | A | * | 1/1988 |
| JP | 05-311379 | | | 11/1993 |
| JP | 09-202953 | | | 8/1997 |
| JP | 2003-027203 | | | 1/2003 |
| JP | 2003-049256 | | | 2/2003 |
| JP | 2003-181549 | | | 7/2003 |
| JP | 2004-043887 | | | 2/2004 |
| JP | 2004-244704 | | | 9/2004 |
| WO | 2007/064172 | | | 6/2007 |

OTHER PUBLICATIONS

Cover page and first page of Chinese Patent No. 102089451B, issued Mar. 6, 2013, and an English translation of the cover page.

* cited by examiner

BEFORE HEATING
FORMATION OF AlN AT INTERFACE
AlN GROWTH
Al LAYER PEELING
POWDER DEPOSITION PART 10
11
12
13
14
3
4

ALUMINUM PLATED STEEL SHEET FOR RAPID HEATING HOT-STAMPING, PRODUCTION METHOD OF THE SAME AND RAPID HEATING HOT-STAMPING METHOD BY USING THIS STEEL SHEET

This application is a national stage application of International Application No. PCT/JP2009/063015, filed 13 Jul. 2009, which claims priority to Japanese Application No. 2008-181341, filed 11 Jul. 2008, which is incorporated by reference in its entirety.

TECHNICAL FIELD

The present invention relates to aluminum plated steel sheet for rapid heating hot-stamping having a coated corrosion resistance and delayed fracture resistance and superior in productivity, a method of production of the same, and a method of rapid heating hot-stamping using that steel sheet.

BACKGROUND ART

In recent years, in applications of automobile use (for example, automobile pillars, door impact beams, bumper beams, etc.), steel sheets achieving both high strength and high shapeability have become desired. As one steel for filling this need, there is TRIP (transformation induced plasticity) steel utilizing the martensite transformation of retained austenite. Using this TRIP steel, it has become possible to produce such auto parts from high strength steel sheet having a 1000 MPa class or so strength and superior in shapeability. However, securing shapeability by further higher strength, for example, 1500 MPa or higher super high strength steel is difficult at the present.

In view of this situation, the technique gathering the most attention recently as a technique achieving both high strength and high shapeability is hot-stamping (also called hot pressing, die quenching, press quenching, etc.) This hot-stamping heats a steel sheet until it reaches a 800° C. or higher austenite region, then hot shapes it to thereby improve the shapeability of high strength steel sheet and cools it after shaping to quench it and obtain the desired material properties.

Hot-stamping is promising as a method for shaping super high strength members, but usually the steel sheet is heated in the air, so oxide (scale) forms on the surface of the steel sheet. Fox this reason, a step of removing the scale is required, but countermeasures are required from the viewpoints of the descaling ability, the environmental load, etc.

As art for improving on this, the art of using Al (aluminum) plated steel sheet as the steel sheet for hot-stamping so as to suppress formation of scale at the time of heating has been proposed (for example, see PTLs 1 to 3). Further, at the time of heating at hot-stamping, the Al plating melts and runs (plating part melts and becomes fluid), so the art of retaining the sheet at a temperature below the melting point of Al (aluminum) so as to avoid running has also been disclosed (see PTL 4).

PRIOR ART DOCUMENTS

Patent Literature

PTL 1: Japanese Patent Publication (A) No. 9-202953
PTL 2: Japanese Patent Publication (A) No. 2003-181549
PTL 3: Japanese Patent Publication (A) No. 2003-49256
PTL 4: Japanese Patent Publication (A) No. 2003-27203

SUMMARY OF INVENTION

Technical Problem

The hot-stamping technology described in the above PTLs 1 to 3 is predicated on heating steel sheet with an Al (aluminum) plating layer not alloyed by Al—Fe alloying by furnace heating etc. under conditions giving a gradual temperature rising rate. For example, in the case of furnace heating, usually, the average temperature rising rate from room temperature to 900° C. or so is 3 to 5° C./sec, so 180 to 290 seconds were required until heating. For this reason, the productivity of parts able to be shaped by hot-stamping was about 2 to 4 pieces/min, that is, the productivity was extremely low.

PTL 4 is art heating steel sheet with an Al plating layer not alloyed by Al—Fe alloying by the relatively fast rate of about 20° C./sec. At such a rate, the problem is shown of the molten metal running. To solve this problem, it is shown to gradually heat steel sheet at the temperature below the melting point to cause alloying during that time (the phenomenon of the plating and steel sheet reacting and changing to an intermetallic compound being called this) so as to raise the melting point of the plating. However, in this case as well, for example, with a 30 μm thick plating layer, gradual heating of 60 seconds is considered required. A total heating time of 100 seconds becomes required. Therefore, from the viewpoint of improvement of the productivity, there was still room for improvement.

To improve the productivity of hot-stamping, it is effective to rapidly heat the sheet such as by ohmic heating, induction heating, etc. However, if rapidly heating, as described in PTL 4 as well, there was the problem that running occurred and the plating thickness became uneven. The inherent cause of running is the melting of plating before alloying in the heating process. That is, if alloying, the melting point rises, so running does not occur, but if rapidly raising the temperature, the temperature reaches the melting point of Al (660° C.) or more before alloying and the Al plating melts. Plated steel sheet with such a nonuniform plating thickness chews into or adheres to the die at the time of stamping, so greatly obstructs productivity. That is, by overcoming this running phenomenon, it becomes possible to achieve improved productivity.

There is also art utilizing radiant heating for rapid heating. That is, rapid heating applying high energy density beams such as near infrared light on the steel sheet is also possible. Electric heating is generally restrictive in terms of the shape of the blank, while radiant heating has the advantage of being less so restrictive. In this regard, if using radiant heating to rapidly heating Al-plated steel sheet, there was the problem that the surface became a mirror surface at the time of melting of plating and the heat absorption efficiency fell so, for example, compared with a non-plated material, the temperature rising rate became smaller.

Further, in using such a high strength steel sheet, it is necessary to consider the delayed fracture due to hydrogen. Delayed fracture itself is an issue common to all high strength steel sheet, but when applying Al-plated steel sheet to hot-stamping, the extremely small diffusion coefficient of hydrogen in Al and Al—Fe alloy becomes a problem. That is, by Al plating, it becomes harder for the hydrogen in the steel to escape. This generally becomes a disadvantage from the viewpoint of delayed fracture. Hydrogen is stored in the steel sheet at the time of production of an Al plating (time of recrystallization annealing after cold rolling), at the time of heating to the austenite region in hot-stamping, and at the time of chemical conversion and electrodeposition coating. Therefore, Al-plated steel sheet may experience delayed fracture due to residual local stress or impartation of stress. As explained above, such members are used as strength members of automobiles. Even small cracks preferably do not occur. By using a rapid heating process, storage of hydrogen at the time of heating to the austenite region is suppressed as a general direction, but when producing Al plating as well, annealing in an atmosphere containing hydrogen is a general practice. It was difficult to remove this residual hydrogen.

For this reason, it is known that it is possible to remove hydrogen stored at the time of producing Al plating if, after producing Al-plated steel sheet, annealing it at 600 to 700° C. or so for a long period of time.

However, if heating for annealing as is in the coil state, as shown in FIG. 1(*a*), there was the problem that powder-like deposits formed on the surface of the coil at the center in the width direction, the phenomenon arose of white streaks being formed around it, and the coil not being able to be used.

In summary, regarding the hydrogen in the steel sheet causing delayed fracture, there is the hydrogen stored at the time of production of the Al-plated steel sheet and the hydrogen stored at the time of heating the steel sheet before hot-stamping. Measures have to be taken against these respectively. For heating the steel sheet before hot-stamping, rapid heating suppresses hydrogen storage, so is an effective means.

However, rapid heating before hot-stamping has the problem, since the Al—Fe alloying is delayed, that the Al plating part melts and runs. Solving this is an important issue not only from the viewpoint of the hydrogen storage, but also from the viewpoint of striking improvement of the productivity. Further, to remove the hydrogen stored at the time of production of Al-plated steel sheet, it is effective to anneal the Al-plated steel sheet at about 600 to 700° C. for a long period of time after production, but if annealing it as is in the coil state, abnormal parts of quality are formed at the surface of the steel sheet. From the viewpoint of the productivity and handling, annealing in the coil state is rational, so elimination of such abnormalities in quality at the surface of steel sheet is also becoming an important issue.

Solution to Problem

The inventors engaged in in-depth research to solve the above problems and as a result discovered that in the annealing performed in the coil state after production of Al-plated steel sheet, if the annealing conditions are within a specific range, no abnormalities in quality will arise at the surface of the steel sheet and, further, the Al plating part will increasingly be alloyed by Al—Fe alloying and thereby completed the present invention. Due to this, they confirmed that even if applying rapid heating before hot-stamping, it is possible to completely prevent running of the plating and, further, to remove the hydrogen remaining in the steel sheet and causing delayed fracture. Simultaneously, by Al—Fe alloying, the surface blackens and rapid heating by radiant heating such as by near infrared light also becomes possible.

The present invention has as its gist the following:

(1) A method of production of aluminum plated steel sheet for rapid heating hot-stamping characterized by annealing aluminum plated steel sheet having an aluminum plating deposition amount per side of 30 to 100 g/m$^2$ in a box annealing furnace as is in a coil state during which annealing by a combination of a retention time and annealing temperature in an inside region including the sides of a pentagon having five points of coordinates (600° C., 5 hours), (600° C., 200 hours), (630° C., 1 hour), (750° C., 1 hour), and (750° C., 4 hours) as vertices in an XY plane having the retention time and annealing temperature as its X-axis and Y-axis and with the X-axis expressed logarithmically.

(2) A method of production of aluminum plated steel sheet for rapid heating hot-stamping as set forth in (1) characterized in that the ingredients of the steel sheet forming the base material of said aluminum plated steel sheet contain, by mass %

C: 0.1 to 0.4%,
Si: 0.01 to 0.6%,
Mn: 0.5 to 3%,
P: 0.005 to 0.05%,
S: 0.002 to 0.02%, and
Al: 0.005 to 0.1%,
further,
one or more of
Ti: 0.01 to 0.1%,
B: 0.0001 to 0.01%, and
Cr: 0.01 to 0.4%, and
a balance of Fe and unavoidable impurities.

(3) A method of production of aluminum plated steel sheet for rapid heating hot-stamping as set forth in (1) or (2) characterized in that in said aluminum plated steel sheet, the aluminum plating deposited on the surface contains Si in 3 to 15 mass %.

(4) An aluminum plated steel sheet for rapid heating hot-stamping characterized by annealing aluminum plated steel sheet having an aluminum plating deposition amount per side of 30 to 100 g/m$^2$ in a box annealing furnace as is in a coil state during which annealing by a combination of a retention time and annealing temperature in an inside region including the sides of a pentagon having five points of coordinates (600° C., 5 hours), (600° C., 200 hours), (630° C., 1 hour), (750° C., 1 hour), and (750° C., 4 hours) as vertices in an XY plane having the retention time and annealing temperature as its X-axis and Y-axis and with the X-axis expressed logarithmically.

(5) An aluminum plated steel sheet for rapid heating hot-stamping as set forth in (4) characterized in that the ingredients of the steel sheet forming the base material of said aluminum plated steel sheet contain, by mass %

C: 0.1 to 0.4%,
Si: 0.01 to 0.6%,
Mn: 0.5 to 3%,
P: 0.005 to 0.05%,
S: 0.002 to 0.02%, and
Al: 0.005 to 0.1%,
further,
one or more of
Ti: 0.01 to 0.1%,
B: 0.0001 to 0.01%, and
Cr: 0.01 to 0.4%, and
a balance of Fe and unavoidable impurities.

(6) An aluminum plated steel sheet for rapid heating hot-stamping as set forth in (4) or (5) characterized in that an L* value of the surface of said aluminum plated steel sheet is 10 to 60.

(7) An aluminum plated steel sheet for rapid heating hot-stamping as set forth in any one of (4) to (6) characterized in that in said aluminum plated steel sheet, the aluminum plating deposited on the surface contains Si in 3 to 15 mass %.

(8) An aluminum plated steel sheet for rapid heating hot-stamping as set forth in any one of (4) to (7) characterized in that in said aluminum plated steel sheet, at the surface of the steel sheet of the base material, there is an Al—Fe alloy layer equivalent to Al concentration of 40 to 70% mass %.

(9) A method of rapid heating hot-stamping characterized by cutting out a stamping blank of an aluminum plated steel sheet as set forth in any one of (4) to (8) from a coil, heating that blank in heating before hot-stamping by an average temperature with a rising rate of 40° C./sec or more and a time of exposure to an environment of 700° C. or more of 20 seconds or less, and then hot-stamping it.

Advantageous Effects of Invention

According to the present invention, in Al-plated steel sheet for hot-stamping, by alloying the Al and Fe up to the surface, not only does it become possible to eliminate the occurrence of running even if rapidly heating the steel sheet before hot-stamping, but also it becomes possible to reduce the risk of delayed fracture. Further, by applying rapid heating, it becomes possible to improve the productivity of hot-stamping.

Further, additional advantageous effects are also observed. In the case of ohmic heating, partial heating was also possible, but it was difficult to heat the portions in contact with the electrodes. When using conventional non-alloyed Al-plated steel sheet, it was necessary to cut off the not heated portions, but according to the present invention, this is no longer necessary. Further, by alloying the Al and Fe at the Al plating part, the spot weldability is improved and it is no longer necessary to frequently regrind the spot welding electrodes. For the coated corrosion resistance as well, in particular coating blisters become harder to occur. According to the present invention, while the not heated portions are not quenched, the part can be used as it is.

BRIEF DESCRIPTION OF DRAWINGS

FIG. 1(*a*) shows typical examples of surface abnormalities of Al-plated steel sheet occurring after box annealing by a photograph.

FIG. 1(*b*) is a conceptual view for explaining the mechanism of such surface abnormalities.

FIG. 1(*c*) is a conceptual view for explaining ideal alloying of an Al plating layer obtained by annealing.

DESCRIPTION OF EMBODIMENTS

Figure 1A:
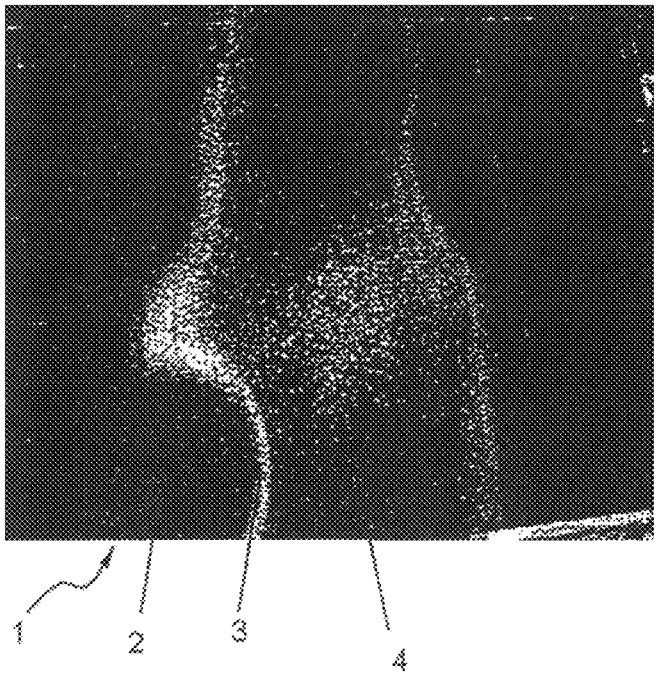
FIG. 1 shows the state of appearance of Al-plated steel sheet after box annealing at 550° C. as is in the coil state and the mechanism for the same.

Below, preferred embodiments of the present invention will be explained while referring to the drawings.

[Summary of Hot-Stamping Method Superior in Productivity and Delayed Fracture Property According to Present Invention]

As explained above, the art described in the above PTLs 1 to 3 was a low productivity process where heating took about 200 seconds or more. If improving the productivity of the hot-stamping by using ohmic heating etc. for rapid heating, as described in PTL 4, there was also the problem of running of the molten plating at the surface of the steel sheet. Here, the running in the heating method using electricity will be explained. Both high frequency heating and ohmic heating are heating methods running current through the steel sheet so as to utilize the resistance heating of the steel sheet. In this regard, if running a current through steel sheet, a magnetic field will be generated and the current and magnetic field will interact resulting in force. This force will result in movement of the molten metal. Depending on the heating method, the direction of the current will differ in various ways, so no generalized statement can be made. Sometimes the center part of the steel sheet will become thicker and sometimes conversely the ends of the steel sheet will become thicker. Further, when arranging the blank vertically, gravity will act and the plating at the bottom of the blank will become thicker in some cases.

According to studies of the inventors, to prevent the plating from running, it is sufficient to reduce the amount of plating deposition. For example, when using Al-plated steel sheet with a plating deposition amount of 30 g/m$^2$ per side and heating it to a temperature of 900 to 1200° C. with a temperature rising rate of 50° C./sec or more, the plating will not run and a smooth surface will result, but with a plating deposition amount of 60 g/m$^2$, examples where the plating runs are obtained. On the other hand, if preventing the plating from running by reducing the plating deposition amount, sufficient coated corrosion resistance cannot be secured. That is, there is a tradeoff between improving productivity and securing corrosion resistance, so in the past it had not been possible to obtain Al-plated steel sheet for rapid heating hot-stamping provided with both superior corrosion resistance and superior productivity.

Therefore, the inventors engaged in intensive studies to obtain steel sheet for rapid heating hot-stamping provided with both superior corrosion resistance and superior productivity and as a result obtained the discovery that it is effective to alloy Al and Fe up to the surface. Further, to obtain superior coated corrosion resistance, a certain amount or more of deposition becomes necessary.

To alloy Al-plated steel sheet up to the surface, heating is necessary. Up to now, if heating for hot-stamping, alloying occurred without problem. It was expected that by heating a coil of Al-plated steel sheet, alloying would be achieved. However, alloying a coil of Al-plated steel sheet by heating was accompanied with far more difficulties than expected. For heating for hot-stamping, a coil is cut into a blank which is then heated in a furnace. Alternatively, it is heated using electric, high frequency waves, etc. Whatever the method, a blank of steel sheet is heated alone. As opposed to this, if heating in the state of the coil as is, the steel is heated in the state with different layers superposed. If heating in this state, the following phenomenon arose.

Figures 1B, 1C:
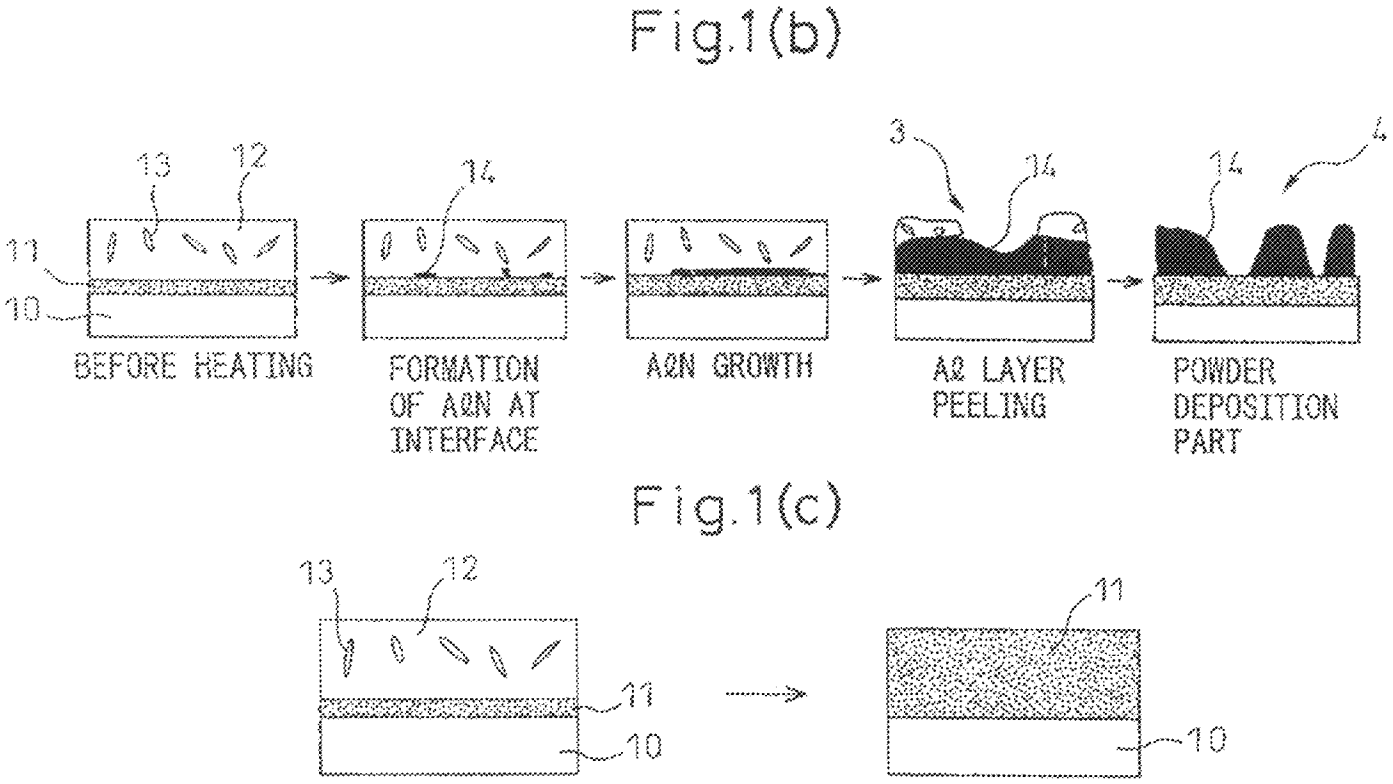

FIG. 1 shows this phenomenon. FIG. 1(*a*) shows surface abnormalities formed when trying to heat and alloy a coil of Al-plated steel sheet in a box annealing furnace in an air atmosphere. The plating composition at this time is Al-about 10% Si. This composition has a melting point of about 600° C. If heating at the melting point or more, melted plating layers are liable to fuse together, so the coil was retained at the annealing temperature 550° C. for about 48 hours. After this, it was discharged from the annealing furnace and the surface was examined, whereupon there were normal sound parts 2 free of abnormalities at the outer edges of the Al-plated steel sheet 1, but a white streak was observed at about ⅓ the way in the width direction of the steel sheet. It was learned that this was a part 3 where part of the Al plating peeled off. Further, a part 4 where a powder-like substance was deposited was observed at the surface at the center part of the width direction of the steel sheet.

This phenomenon appears when annealing steel in a box annealing furnace as is in the coil state. Even under the same annealing conditions, it does not appear even if heating steel sheet alone. It is a phenomenon which appears by heating in the coil state, that is, in the state with layers of steel superposed in close contact. It was learned that the powder-like substance of the powder deposition part 4 was Ala. On the other hand, the portion from which the plating was peeled off at the peeled off part 3 is the non-alloyed Al plating layer. It was confirmed AlN14 was formed at the interface of the Al plating layer 12 and Al—Fe alloy layer 11 and that this AlN14 suppressed the alloying. FIG. 1(*b*) shows this mechanism. The Al-plated steel sheet is comprised of a base material of a steel sheet 10 on which an Al—Fe alloy layer 11 is thinly formed and over which an Al plating layer 12 containing Si13 is provided (drawing at left end). If annealing, at the interface of the alloy layer 11 and the aluminum plating layer 12, AlN14 starts to form (second drawing from the left). Further, at the interface of the alloy layer 11 and the Al plating layer 12, AlN14 grows (third drawing from the left). If continuing to retain the sheet so in the annealing, the AlN14 grows, the Al plating layer becomes thinner, and the layer partially peels off (fourth drawing from the left). This is believed to form the peeled off part 3. It is believed that if the AlN14 further grows, local peeling of the Al plating layer 13 progresses and the rough parts of the AlN layer 14 appear as powder-like shapes (drawing at right end). This is the powder deposition part 4.

This phenomenon is judged to be caused by the nitrogen in the air and the Al of the plating layer reacting and forming AlN. At the end parts, AlN becomes difficult to be formed due to the effects of the oxygen in the atmosphere, but in the coil state, the center part in the width direction is not believed to be affected much by the oxygen. Note that N is derived from the nitrogen in the atmosphere, but AlN starts to be formed from the interface of the Al—Si plating and the alloy layer. This is guessed to be because the nitrogen passes through the Al—Si and the alloy layer has some sort of catalyzing action on formation of AlN.

In the coil state, the nitrogen (N) in the Al plating layer 13 cannot diffuse outward, so the further to the center of the steel sheet in the width direction, the more the Al plating layer peels off. Ideally, as shown in FIG. 1(*c*), all of the Al plating layer 12 of the steel sheet 10 forming the base material becomes an Al—Fe alloy layer 11. It was confirmed that the sound parts 2 at the outer edges of the steel sheet of FIG. 1(*a*) were parts sufficiently alloyed in this way.

In accordance with this finding, the inventors annealed steel in hydrogen not containing nitrogen under the same temperature and time conditions, but it was confirmed that even in hydrogen, alloying was suppressed and the not alloyed Al was observed to peel off. The cause is unclear at the present stage, but it is possible that an aluminum and hydrogen compound is produced and inhibits the alloying. Therefore, in any atmosphere of the air, nitrogen, or hydrogen, annealing in the coil state leads to plating peeling or powder deposition at the surface of the steel sheet or both and sound alloying is impossible. If performing open coil annealing in the air, alloying would appear to be possible, but specialized facilities would become necessary and the process would become extremely expensive, so this is not practical.

In the present invention, the important point is the selection of conditions enabling annealing without causing this phenomenon. The key factor is the retention temperature at the time of annealing. The inventors discovered that when annealing at 550° C. or so, AlN is produced, but if annealing at 600° C., production of AlN can be suppressed. On the other hand, this temperature region is higher than the melting point of Al, so there is a concern of the molten Al fusing, but at 750° C. or less, no fusing occurs and a sound alloy layer can be obtained. At this time, Al forms a reaction product with N or Fe. The formation of AlN and the alloying reaction of Al and Fe compete, but if less than 600° C., AlN is preferentially formed, while if 600° C. or more, the alloying reaction of Al and Fe occurs preferentially.

Annealing in this temperature region is important in the sense of dehydrogenation as well. If the temperature is too high, the solubility limit of hydrogen in the steel rises and the dehydrogenation effect becomes small, while if the temperature is too low, the hydrogen will not sufficiently diffuse out of the system. By annealing at 600 to 700° C., hydrogen stored in the Al plating process is expelled and the amount of diffusible hydrogen contributing to delayed fracture becomes extremely small. By heating at a temperature of 600° C. or more where the plating layer melts, it is considered that diffusion of the hydrogen is promoted.

Based on the above discoveries, the recommended conditions are heating and annealing at 600 to 750° C. in an air atmosphere. By setting the temperature 600° C. or more, the formation of AlN is suppressed, so the atmosphere does not necessarily have to be the air. A nitrogen atmosphere is also possible. However, even at this temperature, AlN can form at the surface in certain amounts, so an air atmosphere is preferable. Even in a nitrogen atmosphere, the condensation point is preferably made −10° C. or more.

[Configuration of Hot-Stamping Method Superior in Productivity and Delayed Fracture Property According to Present Invention]

(Regarding Structure of General Alloy Layer of Al Plated Material)

Figure 2:
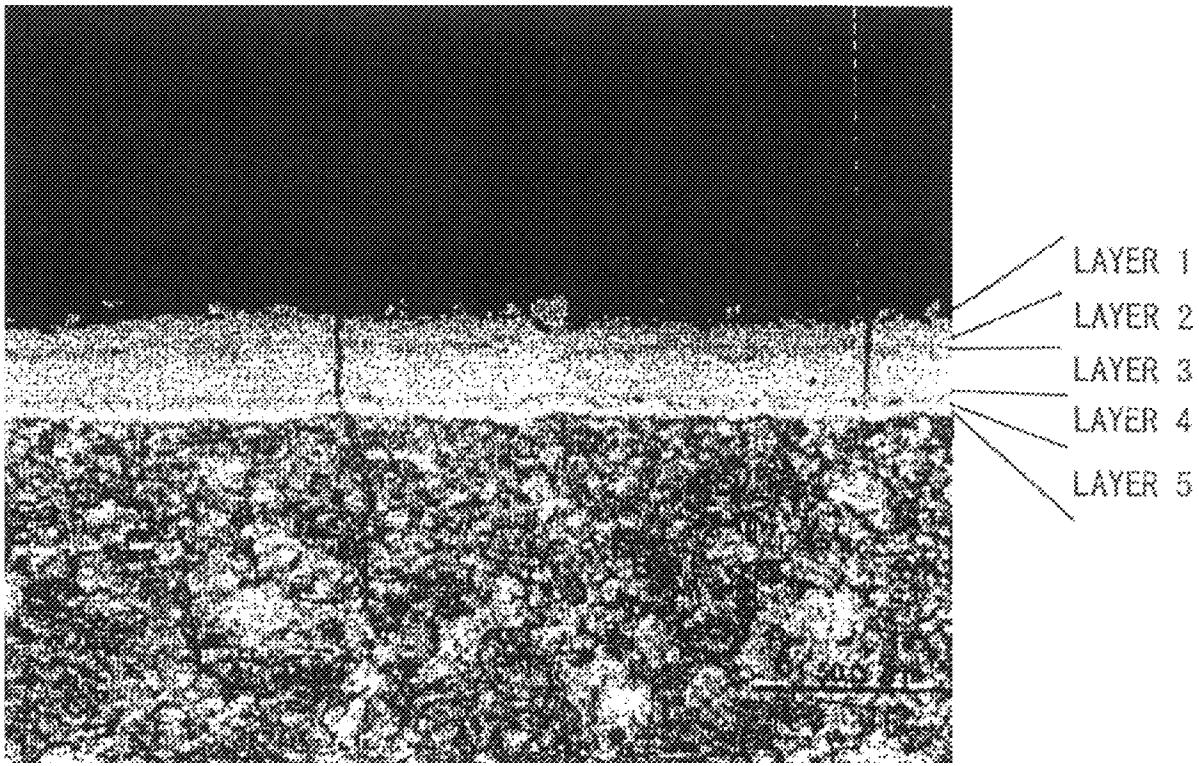
FIG. 2 is an optical micrograph showing a general example of the structure of the cross-sectional structure after heating and alloying Al-plated steel sheet. At the surface part of the plated steel sheet, a layer 1 to layer 5 are confirmed.

Referring to FIG. 2, the structure of a general alloy layer obtained by heating an Al-plated steel sheet will be explained. Note that FIG. 2 is an optical micrograph showing a general example of the structure of the cross-sectional structure after heating and alloying an Al-plated steel sheet.

The plating layer of the Al-plated steel sheet before hot-stamping is comprised of, from the surface, an Al—Si layer and AlFeSi alloy layer. This plating layer is heated in the hot-stamping step to 900° C. or so whereby the Al—Si and the Fe in the steel sheet diffuse with each other and the overall structure changes to an Al—Fe compound. At this time, a' phase containing Si is also partially formed in the Al—Fe compound.

Here, as shown in FIG. 2, the Al—Fe alloy layer after heating and alloying the Al-plated steel sheet generally often becomes a five-layer structure. These five layers are, in FIG. 2, expressed as the first layer to the fifth layer in order from the surface of the plated steel sheet. The Al concentration in the first layer is about 50 mass %, the Al concentration in the second layer is about 30 mass %, the Al concentration in the third layer is about 50 mass %, the Al concentration in the fourth layer is 15 to 30 mass, and the Al concentration in the fifth layer is 1 to 15 mass %. The balance is Fe and Si. Near the interface of the fourth layer and fifth layer, formation of voids is also sometimes observed. The corrosion resistance of this alloy layer is substantially dependent on the Al content. The higher the Al content, the more superior the corrosion resistance. Therefore, the first layer and third layer are the most superior in corrosion resistance. Note that the structure under the fifth layer is the steel material. It is a quenched structure mainly comprised of martensite.

Figure 3:
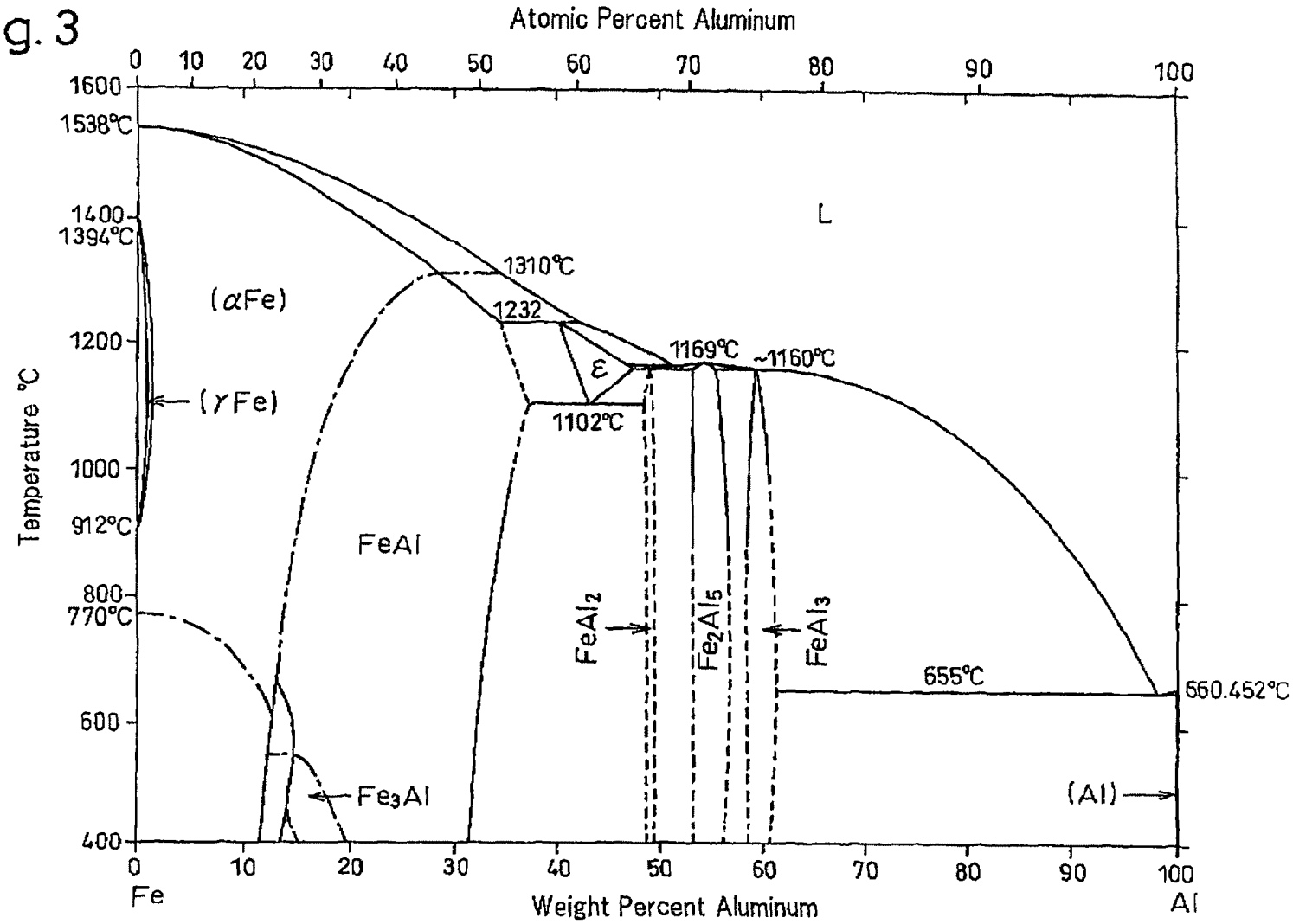
FIG. 3 is an explanatory view showing a binary phase diagram of Fe—Al.

FIG. 3 shows a binary phase diagram of Al—Fe. Referring to this FIG. 3, it can be judged that the first layer and third layer are mainly comprised of $Fe_2Al_5$ and $FeAl_2$ and that the fourth layer and fifth layer respectively correspond to FeAl and αFe. Further, the second layer is a larger containing Si which cannot be explained from the Al—Fe binary phase diagram. The detailed composition is not clear. The inventors guess that $FeAl_2$ and Al—Fe—Si compounds are finely mixed in.

(Regarding Structure of Alloy Layer of Plated Steel Sheet Used for Hot-Stamping Method Superior in Productivity and Delayed Fracture Property of Present Invention)

Next, the structure of the alloy layer of a sample obtained by heating a plated steel sheet for hot-stamping, alloyed in a box annealing furnace according to the present invention, using the ohmic heating method at by 50° C./sec up to 900° C., then immediately annealing it in the dies (hereinafter referred to as the "covering layer") will be explained.

Figure 4:
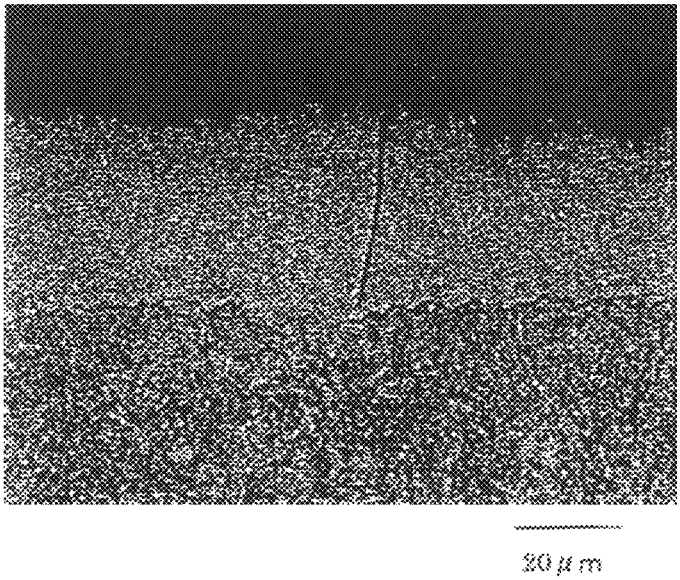
FIG. 4 is an optical micrograph showing an example of the cross-sectional structure of a covering layer according to the present invention.

As the state after typical heating, the state of the covering layer after annealing and when heating at 30° C./sec to 900° C. is shown in FIG. 4. As shown in FIG. 4, a five-layer structure is not shown. The part of the Al—Fe alloy layer having an Al concentration of 40 mass % to 70 mass % occupies at least 60% of the area of the cross-section. This is believed to be because box annealing is relatively low in temperature and that the sheet is rapidly heated after this, so the amount of diffusion of the Fe in the Al plating layer is small.

As a result, a greater effect of improvement of the coated corrosion resistance over the past is observed. In the case of a conventional alloy layer, that is, a five-layer structure such as in FIG. 2, the surface-most layer is lowest in potential, so easily corrodes preferentially. At this time, the width of the coating blisters corresponds to the amount of corrosion of the surface most layer. At this time, even if the amount of corrosion is relatively small, the corrosion occurs at only the surface-most layer, so the area corroded easily becomes larger. That is, coating blisters occur relatively easily. As opposed to this, in the case of the current alloy layer, that is, the structure such as in FIG. 4, a clear layer structure is not exhibited, so it is assumed that the corrosion progresses to the alloy layer as a whole. At this time, if assuming the same amount of corrosion as a five-layer structure, the further it progresses in the sheet thickness direction, the harder it progresses in the surface direction of the steel sheet (width direction and length direction). Therefore, the coating blisters become smaller.

Below, the configuration of the Al-plated steel sheet used for the production of the above-mentioned plated steel sheet for hot-stamping will be explained in detail.

(Regarding Steel Sheet)

Hot-stamping involves pressing by dies and quenching simultaneously, so the rapid heating plated steel sheet for hot-stamping according to the present invention has to have ingredients giving easy quenching. Specifically, as the steel ingredients in the steel sheet, the sheet Preferably contains, by mass %, C, 0.1 to 0.4%, Si: 0.01 to 0.6%, MD: 0.5 to 3%, P: 0.005 to 0.05%, S: 0.002 to 0.02%, and Al: 0.005 to 0.1% and further contains one or more of Ti: 0.01 to 0.1%, B: 0.0001 to 0.01%, and Cr: 0.01 to 0.4%.

Regarding the amount of C, from the viewpoint of improvement of the quenchability, 0.1% or more is preferable. Further, if the amount of C is too great, the drop in the toughness of the steel sheet becomes remarkable, so 0.4 mass % or less is preferable.

If adding Si over 0.6%, the Al plating ability falls, while if made less than 0.01%, the fatigue properties are inferior, so this is not preferable.

Mn is an element contributing to the quenchability. Addition of 0.5% or more is effective, but from the viewpoint of the drop in toughness after quenching, exceeding 3% is not preferable.

Ti is an element improving the heat resistance after aluminum plating. Addition of 0.01% or more is effective, but if excessively added, the C and N react and the steel sheet strength ends up falling, so exceeding 0.1% is not preferable.

B is an element contributing to the quenchability. Addition of 0.0001% or more is effective, but there is a concern over hot cracking, so exceeding 0.01% is not preferable.

Cr is a strengthening element and is effective for improving the quenchability. However, if less than 0.01%, these effects are hard to obtain. Even if contained in over 0.4%, the effect is saturated with annealing in this temperature region. Therefore, 0.4% was made the upper limit.

P, if added in excess, causes brittleness of the steel sheet, so 0.05% or less is preferable. However, removal in the refining process is difficult. From the economic viewpoint, it is rational to make the lower limit concentration 0.005%.

S becomes an inclusion in the steel as MnS. If the MnS is large, this becomes a starting point for fracture and the ductility and toughness are obstructed, so 0.02% or less is preferable. In the same way as P, from the economic perspective of the refining process, the lower limit concentration was made 0.005%.

Al is a plating inhibiting element, so 0.1% or less is preferable. In the same way as P and S, from the economic viewpoint of the refining process, the lower concentration was made 0.005%.

Further, the steel sheet can include as ingredients also N, Mo, Nb, Ni, Cu, V, Sn, Sb, etc. Usually, by mass %, the contents are N: 0.01% or less, Ni: 0.05% or less, and Cu: 0.05% or less.

(Regarding Al Plating)

The method of plating Al on the steel sheet according to the present invention is not particularly limited. The hot dip coating method, electroplating method, vacuum deposition method, cladding method, etc. may be applied. Currently the most prevalent industrially is the hot dip coating method. As the coating bath, one comprised of Al containing 3 mass % to 15 mass % of Si is used. The unavoidable impurity Fe etc. is mixed in this. As other additive elements, Mn, Cr, Mg, Ti, Zn, Sb, Sn, Cu, Ni, Co, In, Bi, Mischmetal, etc. may be mentioned. Addition of Zn and Mg is effective in the sense of making formation of red rust more difficult, but excessive addition of these elements with their high vapor pressures has the problems of production of Zn and Mg fumes, formation of powdery substances derived from Zn and Mg on the surface, etc. Therefore, addition of Zn: 60 mass % or more or Mg: 10 mass % or more is not preferable.

Further, in the present invention, the treatment before Al plating and the treatment after plating are not particularly limited. As the treatment before plating, Ni, Cu, Cr, and Fe preplating etc. may also be applied. Further, as the treatment after plating, a post-treatment coating film designed for primary rust prevention and lubrication may be given. At this time, the coating film is preferably not chromate. Further, since this is heated after plating, a thick resin-based coating film is not desirable. To improve the lubrication ability at the time of hot-stamping, treatment including ZnO is effective. This sort of treatment is also possible.

The thickness of the Al—Fe alloy layer is preferably 10 to 45 μm. If the thickness of the Al—Fe alloy layer is 10 μm or more, after the heating step in the hot-stamping, a sufficient coated corrosion resistance can be secured. The greater the thickness, the more superior the action in corrosion resistance, but on the other hand the larger the sum of the thickness of the Al plating layer and the thickness of the Fe—Al alloy layer, the easier it becomes for the covering layer formed by the heating step to fall off, so the thickness of the covering layer is preferably 45 μm or less. Note that when the deposition amount of the Al plating exceeds 100 g/m$^2$ per side, even if performing Fe—Al alloying as explained above, it is not possible to prevent the plating layer from peeling off and sticking in the dies at the time of stamping and press defects form in the stamped product, so it is necessary to avoid this.

Further, as the hue of the surface, the L* value defined in JIS-Z8729 is measured. The L* value is preferably 10 to 60. This is because due to alloying up to the surface, the brightness falls. If the brightness falls, the blackened surface will be particularly suitable for radiant heating and near infrared heating can be used to obtain a 50° C./sec or more temperature rising rate. An L* value over 60 means that unalloyed Al remains at the surface and is not preferable since the heating rate in radiant heating would fall. The L* should not become 10 or less no matter what the alloying conditions, so 10 was made the lower limit value.

[Method of Production of Plated Steel Sheet for Hot-Stamping Used in Present Invention]

The plated steel sheet for hot-stamping according to the present invention is produced by alloying Al-plated steel sheet comprised of steel of the above-mentioned steel ingredients plated with Al to a deposition amount of 30 to 100 g/m$^2$. Due to this alloying treatment, the Al plating layer alloys with the Fe in the base material to become an Al—Fe alloy layer.

Further, the above alloying treatment is for alloying the Al plating layer after Al plating. The method of annealing the coil in a box furnace after Al plating (box annealing) is preferable. When performing alloying treatment, it is possible to adjust the annealing conditions, that is, the temperature rising rate, maximum peak sheet temperature, cooling rate, and other such conditions so as to control the thickness of the Al plating layer.

Figure 5:
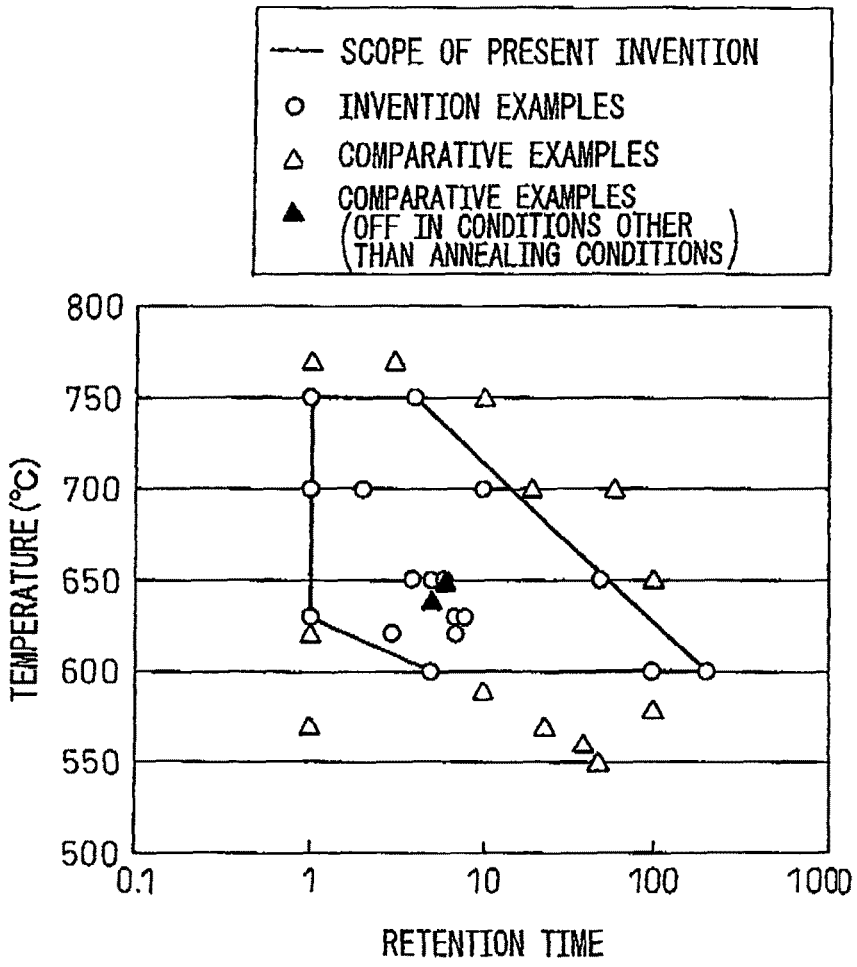
FIG. 5 is a view showing the suitable range of annealing conditions of box annealing according to the present invention.

As the conditions at this time, annealing with a combination of a retention time and annealing temperature in an inside region including the sides of a pentagon having five points of coordinates (600° C., 5 hours), (600° C., 200 hours), (630° C., 1 hour), (750° C., 1 hour), and (750° C., 4 hours) as vertices when making the retention time and annealing temperature the X-axis and Y-axis and expressing the X-axis logarithmically. The conditions are shown in FIG. 5.

The reasons for these settings are as follows: First, the lower limit of temperature of 600° C. is an essential condition for alloying an Al plating without forming AlN as explained above. When annealing an Al plating, the Al in the plating can react with the Fe of the steel sheet and the N in the air. These are competing reactions. At a temperature less than 600° C., the formation of AlN becomes dominant and as a result the reaction between Al and Fe is suppressed. However, at 600° C. or more, the Al—Fe reaction becomes dominant and formation of AlN is suppressed. This can be interpreted as being due to the different temperature dependencies of these reactions.

Further, the upper limit of the temperature is 750° C. This is necessary for suppressing fusion of Al when annealing steel in a coil. That is, if parts of Al melted at a high temperature of over 750° C. come in contact, they will end up easily bonding and the coil will become difficult to unwind. By making the annealing temperature 750° C. or less, it is possible to suppress fusing and obtain an alloyed coil. Further, to lower the hydrogen in the steel during this box annealing, the temperature has to be made 750° C. or less.

Next, regarding the time, 1 hour is the lower limit. This is because in box annealing, with a retention time of 1 hour or less, stable annealing is not possible.

The line connecting (600° C., 5 hours) and (630° C., 1 hour) substantially corresponds to the conditions for alloying up to the surface.

The line connecting (600° C., 200 hours) and (750° C., 4 hours) substantially corresponds to the line giving a good coated corrosion resistance.

The further to the top right in FIG. 5, the higher the temperature and the longer the time of retention and the greater the alloying. As the extent of alloying, if not alloying up to the surface, the temperature rising rate in radiant heating falls and, further, running occurs by ohmic heating etc. Further, if over alloying, the concentration of Al at the surface falls and the coated corrosion resistance tends to fall. To secure a coated corrosion resistance equal to that of the current corrosion resistant material GA (hot dip galvannealed steel sheet), the steel is preferably annealed at the left side from the line connecting (600° C., 200 hours) and (750° C., 4 hours) (low temperature and short time side).

Note that the box annealing conditions have an effect on the plating deposition amount as well. If the plating deposition amount is small, alloying up to the surface is possible even at a low temperature, but if the deposition amount is large, a high temperature or long time becomes necessary as a condition.

(Regarding Hot-Stamping Method)

Note that the Al-plated steel sheet obtained in the above way is preferably then rapidly heated in the hot-stamping step at a temperature rising rate of an average temperature rising rate of 40° C./sec or more. The average temperature rising rate in the case of conventional heating in an electric furnace is 4 to 5° C./sec. The present invention provides a method of hot-stamping superior in productivity and delayed fracture property. By setting the average temperature rising rate 40° C./sec or more, the time until temperature rising can be reduced to 20 seconds or less or one-fifth or less the conventional time. In addition, by setting the time at 700° C. or more extremely short, it is possible to suppress storage of hydrogen at the steel sheet during that time. The heating system at that time is not particularly limited. In the case of using radiant heating, rapid heating is possible by rapidly raising the temperature in a 1300° C. or so high temperature furnace, then moving the blank to a 900° C. or so furnace. The ingredients alloy the surface becomes high in emissivity, so by using a near infrared type heating system, a 50° C./sec or so temperature rising rate is possible.

Further, due to the 70° C./sec to 100° C./sec further higher temperature rising rate, ohmic heating, high frequency induction heating, or another heating system using electricity is more preferable. The upper limit of the temperature rising rate is not particularly defined, but when using the above ohmic heating, high frequency induction heating, or other heating method, in terms of the performance of the system, 300° C./sec or so becomes the upper limit.

Setting the time of exposure to 700° C. or more 20 seconds or less is important for minimizing the hydrogen storage at the time of heating to the austenite region in the hot-stamping. It is preferably to shorten the time as much as possible so as to prevent the hydrogen removed by the box annealing from being taken in again. Here, the time at 700° C. or more is defined since in steel ingredients for hot-stamping, substantially this temperature corresponds to the Ac1 transformation point and hydrogen is actively stored in the austenite region.

Further, in this heating step, the maximum peak sheet temperature is preferably made 850° C. or more. The maximum peak sheet temperature is made this temperature to heat the steel sheet to the austenite region.

The hot stamped steel sheet is then welded, chemically conversion treated, and coated by electrodeposition to obtain the final product. Usually, cationic electrodeposition is used. The film thickness is 1 to 30 μm or so. After electrodeposition coating, sometimes a middle coat, topcoat, etc. is given.

EXAMPLE 1

Below, examples will be used to explain the present invention more specifically.

A cold rolled steel sheet of the steel ingredients shown in Table 1 after the usual hot rolling and cold rolling steps (sheet thickness 1.2 mm) was used as the material for hot dip Al coating. The hot dip Al coating was performed using a non-oxidizing furnace-reducing furnace type line, adjusting the coating deposition amount after coating by the gas wiping method to 20 to 100 g/m$^2$ per side, then cooling. The composition of the coating bath at this time was Al-9% Si-2% Fe. The Fe in the bath was unavoidable Fe supplied from the coating equipment in the bath or the strip. The coating appearance was good with no uncoated parts etc.

Next, this steel sheet was annealed by box annealing in the coil state. The box annealing conditions were an air atmosphere, 540 to 780° C., and 1 to 100 hours. After annealing, blanks (parts of steel sheet cut out in the necessary size from the coiled steel sheet for stamping use) were cut out from the coiled Al-plated steel sheet and used as samples.

The thus prepared samples were evaluated for their properties. As heating of conditions corresponding to hot-stamping, test pieces of 200×200 mm size were heated in the air to 900° C. or more, cooled in the air to about 700° C. in temperature, then pressed between thickness 50 mm dies and rapidly cooled. The cooling rate between the dies at this time was about 150° C./sec. Note that as the heating method for viewing the effects of the heating rate, the three methods of ohmic heating, near infrared heating, and high frequency heating were used. The temperature rising rate at this time was with ohmic heating, about 60° C./sec, with near infrared heating, about 45° C./sec, and with electric furnace radiant heating, about 5° C./sec.

TABLE 1

| Steel Ingredients of Test Material (mass %) | | | | | | | | | |
|---|---|---|---|---|---|---|---|---|---|
| C | Si | Mn | P | S | Al | N | Ti | Cr | B |
| 0.22 | 0.21 | 1.22 | 0.02 | 0.004 | 0.027 | 0.003 | 0.02 | 0.12 | 0.0034 |

These samples were evaluated for coated corrosion resistance. Further, the heated steel sheet samples were measured for changes in sheet thickness before and after heating so as to evaluate the lack of uniformity of thickness of coating due to running.

The coated corrosion resistance was evaluated by the following method. First, the samples were chemically conversion treated by the chemical conversion solution PB-SX35T made by Japan Parkerizing, then were coated by a cationic electrodeposition coating Powernic 110 made by Nippon Paint to about 20 μm thickness. After this, a cutter was used to form cross-cuts in the coating films, a complex corrosion test defined by the Japan Society of Automotive Engineers (JASO M610-92) was performed for 180 cycles (60 days), and the widths of the blisters from the cross-cuts (maximum blister width at one side) were measured. At this time, the blister width of GA (deposition amount at one side of 45 g/m$^2$) was 5 mm. Therefore, if the blister width is 5 mm or less, it was judged that the coated corrosion resistance was good. The coated corrosion resistance column of Table 2 describes this blister width. In Table 2, parts where "-" is described suffered from running and the coating became local, so the corrosion resistance could not be evaluated.

The delayed fracture property was evaluated by the following method. The samples were quenched, then pierced by holes of 10 mm diameter at ordinary temperature by a hydraulic press. The clearance at this time was set at 10%. The samples were allowed to stand for 7 days after piercing, then were observed under an electron microscope to judge the existence of any cracks at the pierced parts. Samples which cracked were evaluated as "poor", while samples which did not were evaluated as "good".

Regarding the alloying, samples alloyed up to the surface were evaluated as "good" while samples which were not alloyed (not yet alloyed) were evaluated as "poor". Samples which were partially alloyed, but for which peeling or powdery deposits were observed in parts were indicated as "poor (part)". Further, samples which were alloyed, but which ended up fusing and could not be opened from the coil state were described as "good (fusion)".

Table 2 summarizes the heating conditions, structure, and results of evaluation of the properties.

TABLE 2

| No. | Deposition per side (g/m$^2$) | Heating temp. (° C.) | Retention time (h) | Atmosphere | Alloying* | L* value | Al—Fe layer thickness (μm) | Heating before hot-stamping: Method | Heating before hot-stamping: Temp. (° C.) | Heating before hot-stamping: Time at 700° C. or more (sec) | Corrosion resistance after coating (mm) | Delayed fracture | Sheet thickness change (mm) | Remarks |
|---|---|---|---|---|---|---|---|---|---|---|---|---|---|---|
| 1 | 20 | 640 | 5 | Air | Good | 43 | 7 | Ohmic | 840 | 7 | 10 | Good | 0 | Comp. ex. |
| 2 | 35 | 620 | 7 | Air | Good | 44 | 12 | Ohmic | 860 | 7 | 5 | Good | 0 | Inv. ex. |
| 3 | 60 | 650 | 5 | Air | Good | 39 | 20 | Near IR | 900 | 8 | 5 | Good | 0 | Inv. ex. |
| 4 | 80 | 630 | 7 | Air | Good | 40 | 27 | Near IR | 930 | 9 | 4 | Good | 0 | Inv. ex. |
| 5 | 100 | 630 | 8 | Air | Good | 46 | 35 | Near IR | 950 | 10 | 4.5 | Good | 0 | Inv. ex. |
| 6 | 80 | 550 | 48 | Air | Poor (part) | — | 27 | — | — | — | — | — | — | Comp. ex. |
| 7 | 80 | 550 | 48 | Nitrogen | Poor (part) | — | 27 | — | — | — | — | — | — | Comp. ex. |
| 8 | 80 | 560 | 40 | Air | Poor (part) | — | 27 | — | — | — | — | — | — | Comp. ex. |
| 9 | 80 | 570 | 24 | Air | Poor (part) | — | 27 | — | — | — | — | — | — | Comp. ex. |

TABLE 2-continued

| No. | Deposition per side (g/m²) | Heating temp. (° C.) | Retention time (h) | Atmosphere | Alloying* | L* value | Al—Fe layer thickness (μm) | Heating before hot-stamping: Method | Heating before hot-stamping: Temp. (° C.) | Heating before hot-stamping: Time at 700° C. or more (sec) | Corrosion resistance after coating (mm) | Delayed fracture | Sheet thickness change (mm) | Remarks |
|---|---|---|---|---|---|---|---|---|---|---|---|---|---|---|
| 10 | 80 | 590 | 10 | Air | Poor (part) | — | 27 | — | — | — | — | — | — | Comp. ex. |
| 11 | 80 | 650 | 4 | Air | Good | 40 | 27 | Ohmic | 870 | 8 | 4 | Good | 0 | Inv. ex. |
| 12 | 80 | 700 | 2 | Air | Good | 39 | 27 | Near IR | 945 | 11 | 4 | Good | 0 | Inv. ex. |
| 13 | 80 | 750 | 1 | Air | Good | 35 | 27 | Near IR | 900 | 9 | 4.5 | Good | 0 | Inv. ex. |
| 14 | 80 | 770 | 1 | Air | Good (fusion) | 37 | 27 | — | — | — | — | — | — | Comp. ex. |
| 15 | 80 | 700 | 60 | Air | Good | 39 | 27 | Ohmic | 900 | 8 | 9 | Good | 0 | Comp. ex. |
| 16 | 80 | 750 | 10 | Air | Good | 38 | 27 | Near IR | 880 | 9 | 10 | Good | 0 | Comp. ex. |
| 17 | 80 | 570 | 1 | Air | Poor | 65 | 27 | Ohmic | 930 | 9 | — | Good | 0.2 | Comp. ex. |
| 18 | 80 | 650 | 6 | Air | Good | 40 | 27 | Near IR | 930 | 14 | 4 | Good | 0 | Inv. ex. |
| 19 | 80 | 650 | 6 | Air | Good | 41 | 27 | High freq. | 930 | 18 | 4 | Good | 0 | Inv. ex. |
| 20 | 80 | 650 | 6 | Air | Good | 41 | 27 | High freq. | 930 | 23 | 4 | Poor | 0 | Comp. ex. |
| 21 | 80 | — | — | — | — | 37 | 27 | Ohmic | 930 | 9 | — | Poor | 0.4 | Comp. ex. |
| 22 | 80 | 630 | 1 | Air | Good | 48 | 27 | Ohmic | 930 | 9 | 4 | Good | 0 | Inv. ex. |
| 23 | 80 | 600 | 200 | Air | Good | 42 | 27 | Ohmic | 930 | 9 | 5 | Good | 0 | Inv. ex. |
| 24 | 80 | 750 | 4 | Air | Good | 36 | 27 | Near IR | 930 | 10 | 5 | Good | 0 | Inv. ex. |
| 25 | 80 | 620 | 3 | Air | Good | 41 | 27 | Near IR | 930 | 10 | 4 | Good | 0 | Inv. ex. |
| 26 | 80 | 620 | 1 | Air | Poor | 65 | 27 | Ohmic | 930 | 9 | — | Good | 0.3 | Comp. ex. |
| 27 | 80 | 650 | 50 | Air | Good | 38 | 27 | Ohmic | 930 | 9 | 4.5 | Good | 0 | Inv. ex. |
| 28 | 80 | 650 | 100 | Air | Good | 38 | 27 | Ohmic | 930 | 9 | 8 | Good | 0 | Comp. ex. |
| 29 | 80 | 700 | 10 | Air | Good | 39 | 27 | High freq. | 930 | 9 | 5 | Good | 0 | Inv. ex. |
| 30 | 80 | 700 | 20 | Air | Good | 38 | 27 | High freq. | 930 | 9 | 10 | Good | 0 | Comp. ex. |
| 31 | 80 | 700 | 1 | Air | Good | 40 | 27 | High freq. | 930 | 9 | 4 | Good | 0 | Inv. ex. |
| 32 | 80 | 580 | 100 | Air | Poor (part) | — | 27 | — | — | — | — | — | | Comp. ex. |
| 33 | 80 | 600 | 100 | Air | Good | 41 | 27 | Ohmic | 930 | 9 | 4.5 | Good | 0 | Inv. ex. |
| 34 | 80 | 770 | 3 | Air | Good (fusion) | 37 | 27 | — | — | — | — | — | — | Comp. ex. |

If the deposition amount is too low, running will not occur, but a sufficient coated corrosion resistance cannot be obtained (No. 1). If the box annealing conditions do not enable alloying up to the surface (Nos. 17 and 26), the surface becomes high in L* value and Al remains. At this time, running occurred, the sheet thickness locally became thicker by 0.2 mm or so, and the corrosion resistance could not be evaluated. Further, if the temperature in the box annealing is too high, the coil ends up fusing (Nos. 14 and 34). On the other hand, if the temperature is too low, AlN was formed or peeling of the plating at the surface or deposition of powdery matter was observed (Nos. 6, 7, 8, 9, 10, and 32). Under conditions of too long a retention time (Nos. 15, 16, and 30), with box annealing, the alloying progressed too much and a drop in coated corrosion resistance was observed. Nos. 18 to 20 are cases of increasing the retention time at a high temperature. If the time of exposure to 700° C. or more is made 20 seconds or more, it is believed that hydrogen storage occurred during this interval and delayed fracture was observed at the pierced part. Further, in the case of not applying box annealing (No. 21), running occurred and delayed fracture occurred. On the other hand, at the level of heating under conditions commensurate with the deposition amount, alloying proceeded up to the surface, the coated corrosion resistance was good, and no changes in the sheet thickness could be observed.

EXAMPLE 2

Cold rolled steel sheets (sheet thickness 1.2 mm) having the various steel ingredients shown in Table 3 were hot dip aluminum coated by the same procedure as in Example 1. The coating deposition amount was made 60 g/m² per side. These aluminum-plated steel sheets were heated using box annealing at 620° C. for 8 hours.

Next, ohmic heating was used to heat the steel sheets by an average temperature rising rate of 60° C./sec to a peak temperature of 900° C., then the steel sheets were quenched in the dies. The hardness after quenching (Vicker's hardness, load 10 kg) was measured. The results are also shown in Table 3. If the steel contains low C, the hardness after quenching falls, so it is learned that an amount of C of 0.10 mass % or more is preferable. Note that at this time, no running occurred in any of the test pieces.

TABLE 3

| | Steel Ingredients of Test Materials (mass %) | | | | | | | | | | |
|---|---|---|---|---|---|---|---|---|---|---|---|
| | C | Si | Mn | P | S | Al | N | Ti | Cr | B | Hv |
| A | 0.02 | 0.19 | 1.21 | 0.02 | 0.004 | 0.023 | 0.003 | 0.02 | 0.13 | 0.0030 | 260 |
| B | 0.10 | 0.20 | 1.21 | 0.02 | 0.005 | 0.021 | 0.003 | 0.02 | 0.13 | 0.0033 | 390 |
| C | 0.15 | 0.20 | 1.21 | 0.02 | 0.005 | 0.023 | 0.002 | 0.02 | 0.13 | 0.0031 | 440 |

EXAMPLE 3

Using cold rolled steel sheet having the steel ingredients of Table 1 (sheet thickness 1.6 mm), the same method as in Example 1 was used to coat Al to 80 g/m$^2$ per side. After this, a solution of a ZnO particle suspension (NanoTek Slurry made by C.I. Kasei) to which a water-soluble acrylic resin was added in an amount of 20% by weight ratio with respect to the ZnO was coated to give Zn of 1 g/m$^2$, then the sheet was dried at 80° C. This material was annealed under box annealing conditions of 630° C. and 7 hours retention to cause alloying up to the surface. The L* value at this time was 52.

This sample was heated by the ohmic heating method to raise it to 900° C., then rapidly cooled in the dies without any retention time. The average temperature rising rate at this time was 60° C./sec. The thus produced material was evaluated for coated corrosion resistance by a method similar to Example 1, whereupon the blister width was 1 mm. Conditions substantially the same as these conditions are found in No. 4 of Table 2, but even compared with this, extremely superior corrosion resistance was exhibited. From this, it is believed that applying treatment including ZnO to the Al-plated surface can further improve the coated corrosion resistance.

EXAMPLE 4

From coil alloyed under the conditions of No. 11 of Table 2, a 200×500 mm blank was cut. This was heated by the ohmic heating method while clamping electrodes at the two ends in the longitudinal direction. The conditions at this time were the same as No. 11 of Table 2. The portions of this sample which were in contact with the electrodes were cut out and measured for cross-sectional hardness, whereupon the hardness was found to be Hv220, that is, no quenching. The coated corrosion resistance of these portions was evaluated by the method shown in Example 1, whereupon the blister width was an extremely good 2 mm. For the spot weldability as well, 500 points at a time were welded by chrome-copper DR electrodes (tip size 6 mm), a pressing force of 400 kgf, and a current of 7 kA. The changes in the nugget size were confirmed by examination of the cross-section. The number of welds until the nugget size became 4.4 mm or less was evaluated, whereupon it was found to be 5000 or more.

Next, No. 21 of Table 2, that is, non-annealed Al-plated steel sheet, was heated under similar conditions by ohmic heating and the portions in contact with the electrodes were evaluated for coated corrosion resistance and spot weldability. As a result, the blister width was 21 mm and the number of welds was 1000 or less.

From the results, it was confirmed that the properties of the portions contacted by the electrodes at the time of rapid heating were greatly improved by alloying.

Above, preferred embodiments of the present invention were explained with reference to the attached drawings, but needless to say the present invention is not limited to these embodiments. Any person skilled in the art clearly could conceive of various modifications or revisions within the scope described in the claims. These are naturally also understood as falling under the technical scope of the present invention.

INDUSTRIAL APPLICABILITY

The present invention, as explained above, solves the problem of melting of Al (problem of running) due to the insufficient Al—Fe alloying, which had been a problem in the past in applying hot-stamping to Al-plated steel sheet, and the abnormalities on the surface of steel sheet arising at the time of annealing in the coil state. Further, regarding the problem of delayed fracture due to residual hydrogen, which had been a problem in application of hot-stamping to Al-plated steel sheet, as well, the present invention has the effect of elimination of the stored hydrogen, so this problem is also solved.

Therefore, the present invention increases the possibility of application of hot-stamping to Al-plated steel sheet. Application is expected not only for production of steel sheet, but also in a broad range of industrial machinery fields such as automotive materials. We are confident that it will contribute to technological development.

REFERENCE SIGNS LIST

1 Al-plated steel sheet
2 sound part after box annealing (alloyed part)
3 abnormal part of surface after box annealing (peeled part)
4 abnormal part of surface after box annealing (powder deposited part)
10 steel sheet forming base material of Al-plated steel sheet
11 Al—Fe alloy layer
12 Al plating layer (Al—Si plating layer)
13 Si
14 AlN

The invention claimed is:

1. A method of production of aluminum plated steel sheet for rapid heating hot-stamping, the method comprising:

annealing aluminum plated steel sheet in a coil state in a box annealing furnace, the aluminum plated steel sheet in the coil state having aluminum plating deposited in an amount of 30 to 100 g/m$^2$ per side; wherein when the annealing retention time and annealing temperature are plotted in an XY plane, wherein the retention time is the X-axis and the annealing temperature is the Y-axis, and the X-axis is expressed logarithmically, the annealing retention time and annealing temperature fall within an inside region, including the sides, of a pentagon, having vertices at five points of the XY plot with coordinates of X=5 hours, Y=600° C.; X=200 hours, Y=600° C.; X=1 hour, Y=630° C.; X=1 hour, Y=750° C.; and X=4 hours, Y=750° C.

2. The method of production of aluminum plated steel sheet for rapid heating hot-stamping as set forth in claim 1, wherein the steel sheet forming the base material of the aluminum plated steel sheet comprises, by mass %

C: 0.1 to 0.4%,
Si: 0.01 to 0.6%,
Mn: 0.5 to 3%,
P: 0.005 to 0.05%,
S: 0.002 to 0.02%, and
Al: 0.005 to 0.1%,
further, one or more of Ti: 0.01 to 0.1%, B: 0.0001 to 0.01%, and Cr: 0.01 to 0.4%, and
a balance of Fe and unavoidable impurities.

3. The method of production of aluminum plated steel sheet for rapid heating hot-stamping as set forth in claim 1, wherein the aluminum plating deposited on the surface of the aluminum plated steel sheet contains Si in an amount of 3 to 15 mass %.

4. A method of rapid heating hot-stamping, comprising cutting out a stamping blank of an aluminum plated steel sheet from a coil, heating that blank before hot-stamping at a rising rate of 40° C./sec or more and a time of exposure to an environment of 700° C. or more of 20 seconds or less, and then hot-stamping it wherein the aluminum plated steel sheet comprises:

aluminum plated steel sheet, annealed in a coil state in a box annealing furnace, the aluminum plated steel sheet in the coil state having aluminum plating deposited in an amount of 30 to 100 g/m$^2$ per side; wherein when the annealing retention time and annealing temperature are plotted in an XY plane, wherein the retention time is the X-axis and the annealing temperature is the Y-axis, and the X-axis is expressed logarithmically, the annealing retention time and annealing temperature fall within an inside region, including the sides, of a pentagon, having vertices at five points of the XY plot with coordinates of X=5 hours, Y=600° C.; X=200 hours, Y=600° C.; X=1 hour, Y=630° C.; X=1 hour, Y=750° C.; and X=4 hours, Y=750° C.

5. The method of production of aluminum plated steel sheet for rapid heating hot-stamping as set forth in claim 2, wherein the aluminum plating deposited on the surface of the aluminum plated steel sheet contains Si in an amount of 3 to 15 mass %.

6. The method as set forth in claim 4, wherein the steel sheet forming the base material of the aluminum plated steel sheet comprises, by mass %

C: 0.1 to 0.4%,
Si: 0.01 to 0.6%,
Mn: 0.5 to 3%,
P: 0.005 to 0.05%,
S; 0.002 to 0.02%, and
Al: 0.005 to 0.1%,
further, one or more of Ti: 0.01 to 0.1%, B: 0.0001 to 0.01%, and Cr: 0.01 to 0.4%, and
a balance of Fe and unavoidable impurities.

7. The method as set forth in claim 4, wherein the surface of the aluminum plated steel sheet has an L* value of 10 to 60.

8. The method as set forth in claim 4, wherein the aluminum plating deposited on the surface of the aluminum plated steel sheet contains Si in an amount of 3 to 15 mass %.

9. The method as set forth in claim 4, wherein the aluminum plated steel sheet further comprises an Al—Fe alloy layer having an Al concentration of 40 to 70 mass % at the surface of the steel sheet of the base material of the aluminum plated steel sheet.

* * * * *

UNITED STATES PATENT AND TRADEMARK OFFICE

CERTIFICATE OF CORRECTION

PATENT NO. : 8,992,704 B2
APPLICATION NO. : 12/737398
DATED : March 31, 2015
INVENTOR(S) : Jun Maki et al.

It is certified that error appears in the above-identified patent and that said Letters Patent is hereby corrected as shown below:

In the Specification

Column 1, line 47, change “Fox this reason” to -- For this reason --;

Column 7, line 11, change “part 4 was Ala.” to -- part 4 was AlN. --;

Column 8, lines 47-48, change “At this time, a’ phase” to -- At this time, a phase --;

Column 9, line 55, change “the sheet Preferably contains” to -- the sheet preferably contains --;

Column 9, lines 55-56, change “by mass %, C, 0.1 to 0.4%” to -- by mass %, C: 0.1 to 0.4% --;

Column 9, line 56, change “MD: 0.5 to 3%” to -- Mn: 0.5% to 3% --; and

In the Claims

Column 20, line 8, change “S; 0.002 to 0.02%” to -- S: 0.002 to 0.02% --.

Signed and Sealed this
Sixteenth Day of February, 2016

Michelle K. Lee

Michelle K. Lee
*Director of the United States Patent and Trademark Office*